US012623136B2

(12) United States Patent
Fogleman et al.

(10) Patent No.: US 12,623,136 B2
(45) Date of Patent: May 12, 2026

(54) METHODS, DEVICES, AND SYSTEMS FOR FACILITATING OFFICIALS DURING A SPORTING EVENT

(71) Applicant: UStopIt, Inc., Raleigh, NC (US)

(72) Inventors: Keith David Fogleman, Raleigh, NC (US); Benjamin W. Bomer, Swannanoa, NC (US); Freddie L. Davis, Mills River, NC (US); Belvin S. Freeman, Asheville, NC (US); Daniel J. Conti, Weaverville, NC (US)

(73) Assignee: UStoplt, Inc., Raleigh, NC (US)

( * ) Notice: Subject to any disclaimer, the term of this patent is extended or adjusted under 35 U.S.C. 154(b) by 235 days.

(21) Appl. No.: 18/413,228

(22) Filed: Jan. 16, 2024

(65) Prior Publication Data

US 2024/0149138 A1 May 9, 2024

Related U.S. Application Data

(63) Continuation of application No. PCT/US2022/073789, filed on Jul. 15, 2022.
(Continued)

(51) Int. Cl.
*A63B 71/06* (2006.01)
*G07C 1/28* (2006.01)

(52) U.S. Cl.
CPC .. *A63B 71/0669* (2013.01); *A63B 2071/0655* (2013.01); *A63B 2225/50* (2013.01)

(58) Field of Classification Search
CPC ..... A63B 71/0669; A63B 2071/0655; A63B 2225/50; G07C 1/28
(Continued)

(56) References Cited

U.S. PATENT DOCUMENTS 4,637,732 A 1/1987 Jones
5,065,251 A * 11/1991 Shuhart, Jr. ..... H04N 5/76 386/E5.001
(Continued)

FOREIGN PATENT DOCUMENTS

CA 2563478 A1 10/2005
DE 2630902 A1 1/1978
(Continued)

OTHER PUBLICATIONS

"Bodet_Resultattavier", Feb. 8, 2019 17 pages (Year: 2019).*
(Continued)

*Primary Examiner* — James D Nigh
(74) *Attorney, Agent, or Firm* — NK Patent Law

(57) ABSTRACT

Disclosed herein are systems, methods, and devices for facilitating officials during a sporting event. According to one embodiment, a device is disclosed including a processor, a memory electrically coupled with the processor, a microphone interface electrically coupled with the processor, a user interface electrically coupled with the processor, a haptic feedback device electrically coupled with the processor; and a wireless transceiver electrically coupled with the processor. The processor is configured for receiving a first audio signal via the microphone interface; determining the first audio signal is associated with a first whistle blow; and upon determining the first audio signal is associated with the first whistle blow, transmitting a first device message via the wireless transceiver to an access point; receiving a first access point acknowledgment message from the access point; and upon receiving the first access point acknowledgement message, activating the haptic feedback device for a first period of time.

20 Claims, 11 Drawing Sheets

Related U.S. Application Data

(60) Provisional application No. 63/222,715, filed on Jul. 16, 2021.

(58) Field of Classification Search
USPC ..... 700/92
See application file for complete search history.

(56) References Cited

U.S. PATENT DOCUMENTS

| | | | | |
|---|---|---|---|---|
| 5,293,354 | A * | 3/1994 | Costabile | G04F 8/08 455/100 |
| 6,369,697 | B1 | 4/2002 | Poole | |
| 6,603,711 | B2 * | 8/2003 | Calace | A63B 71/0605 368/10 |
| 6,816,442 | B1 | 11/2004 | Heiman | |
| 7,031,225 | B2 * | 4/2006 | McDonald | G04F 8/08 455/100 |
| 7,057,975 | B2 | 6/2006 | Stobbe | |
| 7,394,348 | B2 | 7/2008 | Roeske | |
| 7,920,052 | B2 | 4/2011 | Costabile | |
| 8,547,248 | B2 | 10/2013 | Zdeblick | |
| 10,504,300 | B2 * | 12/2019 | Costabile | G07C 1/28 |
| 2005/0162257 | A1 | 7/2005 | Gonzalez | |
| 2006/0109089 | A1 * | 5/2006 | Boehm | G04F 10/00 340/326 |
| 2007/0241867 | A1 | 10/2007 | Burke | |
| 2007/0242839 | A1 * | 10/2007 | Kim | H04R 3/00 381/113 |
| 2008/0123474 | A1 | 5/2008 | Jung | |
| 2009/0309727 | A1 | 12/2009 | Rice | |
| 2010/0085167 | A1 | 4/2010 | Costabile | |
| 2012/0002509 | A1 * | 1/2012 | Saguin | G08C 23/02 368/3 |
| 2014/0091623 | A1 * | 4/2014 | Shippy | H02J 7/0068 307/31 |
| 2016/0012810 | A1 * | 1/2016 | Cronin | G08B 7/00 340/323 R |
| 2017/0169695 | A1 * | 6/2017 | Poisner | A63F 13/46 |
| 2017/0257162 | A1 * | 9/2017 | Panther | A61B 5/4812 |
| 2018/0214760 | A1 * | 8/2018 | Andrews | H04W 4/02 |
| 2019/0214019 | A1 * | 7/2019 | White | H04W 4/80 |
| 2021/0375070 | A1 * | 12/2021 | Costabile | A63B 71/06 |
| 2022/0080286 | A1 * | 3/2022 | Chau | A63B 71/0669 |
| 2024/0149138 | A1 * | 5/2024 | Fogleman | A63B 71/0669 |

FOREIGN PATENT DOCUMENTS

| | | | |
|---|---|---|---|
| DE | 4405714 | A1 | 8/1995 |
| GB | 2320771 | A | 7/1998 |
| JP | 2003036455 | A | 2/2003 |
| SU | 1753481 | A1 | 8/1992 |
| WO | 0073858 | A2 | 12/2000 |
| WO | 2004025575 | A1 | 3/2004 |
| WO | 2013011259 | A1 | 1/2013 |

OTHER PUBLICATIONS

Lopes et al. "Whistle Sound Recognition in a noisy environment", Feb. 9, 2016, 8 pages (Year: 2016).*

Newberry "NCAA fails to keep up with matters of the clock", Lubbock Avalanche-Journal, Mar. 23, 2011, 5 pages (Year: 2011).*

Daley "Officials' Whistles Go Digital", retrieved from https://www.sportsvideo.org/2020/07/16/officials-whistles-go-digital/, Jul. 16, 2020 4 pages (Year: 2020).*

ISA/US: International Search Report and Written Opinion for International Patent Application PCT/US2022/073789, dated Oct. 6, 2022, 14 pages.

Uploaded document #2 submitted with third party observation dated Apr. 18, 2023 for International Patent Application PCT/US2022/073789, "Gen 5 NBA Setup Guide and User Manual", Precision Time Systems, Inc., Version 1.0, dated Jun. 2020, 14 pages.

Uploaded document #3 submitted with third party observation dated Apr. 18, 2023 for International Patent Application PCT/US2022/073789, "Haptic Solutions for Wearable Devices", Texas Instruments, dated Aug. 2014, 3 pages.

Uploaded documents #4 submitted with third party observation dated Apr. 18, 2023 for International Patent Application PCT/US2022/073789, "DRV2605LDGS Haptic Driver Mini Board", Texas Instruments, User's guide, dated Aug. 2014, 9 pages.

PCT: Third Party Observation for International Patent Application PCT/US2022/073789, submitted on Apr. 18, 2023, 4 pages.

Uploaded documents #7 submitted with third party observation dated Apr. 18, 2023 for International Patent Application PCT/US2022/073789, "Further information in Connection with Citation No. 1" and "Further information in Connection with Citation No. 2", 2 pages.

WIPO: International Preliminary Report on Patentability for International Patent Application PCT/US2022/073789, dated Jan. 16, 2024, 13 pages.

EPO, Extended European Search Report for corresponding European Patent Application No. 22843076.5, mailed Jun. 11, 2025, 9 pages.

* cited by examiner

METHODS, DEVICES, AND SYSTEMS FOR FACILITATING OFFICIALS DURING A SPORTING EVENT

PRIORITY CLAIM

This application is a continuation of PCT Patent Application No. PCT/US2022/073789 entitled "METHODS, DEVICES, AND SYSTEMS FOR FACILITATING OFFICIALS DURING A SPORTING EVENT," which was filed on Jul. 15, 2022, which claims benefit of and priority to U.S. Provisional Patent Application No. 63/222,715 titled "IMPROVED METHODS, DEVICES, AND SYSTEMS FOR FACILITATING OFFICIALS DURING A SPORTING EVENT," filed Jul. 16, 2021, the contents of both of which are incorporated by reference herein.

TECHNICAL FIELD

The present invention relates to a mobile device and more specifically to methods, devices, and systems for facilitating officials during a sporting event.

BACKGROUND

A key requirement in officiating sporting events (e.g. basketball games, etc.) is providing accurate and fair timekeeping. Timekeepers have to listen carefully for an on court referee whistle blow and as quickly as possible have to stop the game clock. Additionally, they have to watch for the indication from the referee to start the game clock. Any delay and/or failure to accurately stop or start the game clock requires game delay for the timekeeper to rewind the game clock to the correct setting. Such errors further delay the game and cause players, coaches, and fans much concern while putting uncertainty into the overall outcome of the game.

Accordingly, a need exists to better facilitate officials during sporting events including accurate and fair timekeeping.

SUMMARY

The presently disclosed subject matter is directed toward methods, devices, and systems for facilitating officials during a sporting event.

According to one embodiment, a device is disclosed including a processor, a memory electrically coupled with the processor, a microphone interface electrically coupled with the processor, a user interface electrically coupled with the processor, a haptic feedback device electrically coupled with the processor; and a wireless transceiver electrically coupled with the processor. The processor is configured for receiving a first audio signal via the microphone interface; determining the first audio signal is associated with a first whistle blow; and upon determining the first audio signal is associated with the first whistle blow, transmitting a first device message via the wireless transceiver to an access point; receiving a first access point acknowledgment message from the access point; and upon receiving the first access point acknowledgement message, activating the haptic feedback device for a first period of time. The access point is electrically coupled with a scoreboard controller.

In some embodiments, the access point may be configured for transmitting a first access point message to the scoreboard controller upon receiving the first device message.

In some embodiments, the first access point message may be configured to stop a game clock associated with the scoreboard controller.

In some embodiments, the processor may be further configured for receiving a first device command from the user interface; and upon receiving the first device command, transmitting a second device message to the access point; and activating the haptic feedback device for a second period of time. The access point may be further configured to transmit a second access point message to the scoreboard controller upon receiving the second device message. The second access point message may be configured to start the game clock.

In some embodiments, the processor may be further configured for receiving a third access point message via the wireless transceiver; and upon receiving the third access point message, activating the haptic feedback device for a third period of time. The third access point message may be associated with a second whistle blow detected by another mobile device.

In some embodiments, the processor may be further configured for receiving a fourth access point message via the wireless transceiver; and upon receiving the fourth access point message, activating the haptic feedback device for a fourth period of time. The fourth access point message may be associated with a start of the game clock.

In some embodiments, the user interface may include a push button.

In some embodiments, the mobile device further may include a belt clip.

In some embodiments, the microphone interface may be configured to be electrically coupled with a lavalier microphone. In other embodiments, the microphone interface may be configured to be wirelessly coupled with a microphone. In certain embodiments the microphone interface may be a wireless personal area network (PAN) interface. The microphone interface may be compliant to at least one version of a Bluetooth® standard.

In some embodiments, the mobile device may further include a rechargeable battery. The rechargeable battery may be a lithium-ion rechargeable battery.

In some embodiments, the mobile device may further include a charging port electrically coupled with the rechargeable battery. In certain embodiments, the charging port may be compliant to a universal serial bus (USB) charger. In other embodiments, the charging port may be a wireless charging port.

In some embodiments, the mobile device may further include a display electrically coupled with the processor. In certain embodiments, the display may be configured to provide a game status of the sporting event.

In some embodiments, the official may be a referee and the sporting event may be a basketball game.

In some embodiments, determining the first audio signal may be associated with the first whistle blow and may include determining a spectral component within the first audio signal above predetermined sound pressure threshold and having a frequency component between 2700 Hertz and 4700 Hertz. In certain embodiments, the predetermined sound pressure threshold may be between 104 decibels and 116 decibels.

In some embodiments, the predetermined sound pressure threshold may be configurable via the user interface.

In some embodiments, the predetermined sound pressure threshold may be manually configurable based on background noise.

In some embodiments, the predetermined sound pressure threshold may be configurable automatically based on background noise.

In some embodiments, the predetermined sound pressure threshold may be configurable automatically based on a calibration cycle performed by an official.

In another embodiment, a method is disclosed for facilitating an official of a sporting event. The method includes receiving a first audio signal via a microphone interface of a mobile device. The mobile device includes a processor electrically with the microphone interface, a memory electrically coupled with the processor, a user interface electrically coupled with the processor, a haptic feedback device electrically coupled with the processor, and a wireless transceiver electrically coupled with the processor. The method further includes receiving a first audio signal via the microphone interface; determining the first audio signal is associated with a first whistle blow; upon determining the first audio signal is associated with the first whistle blow, transmitting a first device message via the wireless transceiver to an access point; receiving a first access point acknowledgment message from the access point; and upon receiving the first access point acknowledgement message, activating the haptic feedback device for a first period of time. The access point is electrically coupled with a scoreboard controller.

In some embodiments, the access point may be configured for transmitting a first access point message to the scoreboard controller upon receiving the first device message.

In some embodiments, the first access point message may be configured to stop a game clock associated with the scoreboard controller.

In some embodiments, the method may further include receiving a first device command from the user interface; and upon receiving the first device command, transmitting a second device message to the access point and activating the haptic feedback device for a second period of time, wherein:

In some embodiments, the access point may be configured to transmit a second access point message to the scoreboard controller upon receiving the second device message; and the second access point message may be configured to start the game clock.

In some embodiments, the method may further include receiving a third access point message via the wireless transceiver; and upon receiving the third access point message, activating the haptic feedback device for a third period of time. The third access point message may be associated with a second whistle blow detected by another mobile device.

In some embodiments, the method may further include receiving a fourth access point message via the wireless transceiver; and upon receiving the fourth access point message, activating the haptic feedback device for a fourth period of time. The fourth access point message may be associated with a start of the game clock.

In some embodiments, the user interface may include a push button.

In some embodiments, the mobile device may include a belt clip.

In some embodiments, the microphone interface may be configured to be electrically coupled with a lavalier microphone. In other embodiments, the microphone interface may be configured to be wirelessly coupled with a microphone. In certain embodiments the microphone interface may be a wireless personal area network (PAN) interface. The microphone interface may be compliant to at least one version of a Bluetooth® standard.

In some embodiments, the mobile device may further include a rechargeable battery. The rechargeable battery may be a lithium-ion rechargeable battery.

In some embodiments, the mobile device may further include a charging port electrically coupled with the rechargeable battery. In certain embodiments, the charging port may be compliant to a universal serial bus (USB) charger. In other embodiments, the charging port may be a wireless charging port.

In some embodiments, the mobile device may further include a display electrically coupled with the processor. In certain embodiments, the display may be configured to provide a game status of the sporting event.

In some embodiments, the official may be a referee and the sporting event may be a basketball game.

In some embodiments, determining the first audio signal may be associated with the first whistle blow and may include determining a spectral component within the first audio signal above predetermined sound pressure threshold and having a frequency component between 2700 Hertz and 4700 Hertz. In certain embodiments, the predetermined sound pressure threshold may be between 104 decibels and 116 decibels.

In some embodiments, the predetermined sound pressure threshold may be configurable via the user interface.

In some embodiments, the predetermined sound pressure threshold may be manually configurable based on background noise.

In some embodiments, the predetermined sound pressure threshold may be configurable automatically based on background noise.

In some embodiments, the predetermined sound pressure threshold may be configurable automatically based on a calibration cycle performed by an official.

The features and advantages described in this summary and the following detailed description are not all-inclusive. Many additional features and advantages will be apparent to one of ordinary skill in the art in view of the drawings, specification, and claims presented herein.

BRIEF DESCRIPTION OF THE DRAWINGS

The present embodiments are illustrated by way of example and are not intended to be limited by the figures of the accompanying drawings. In the drawings.

DETAILED DESCRIPTION

Figure 1:
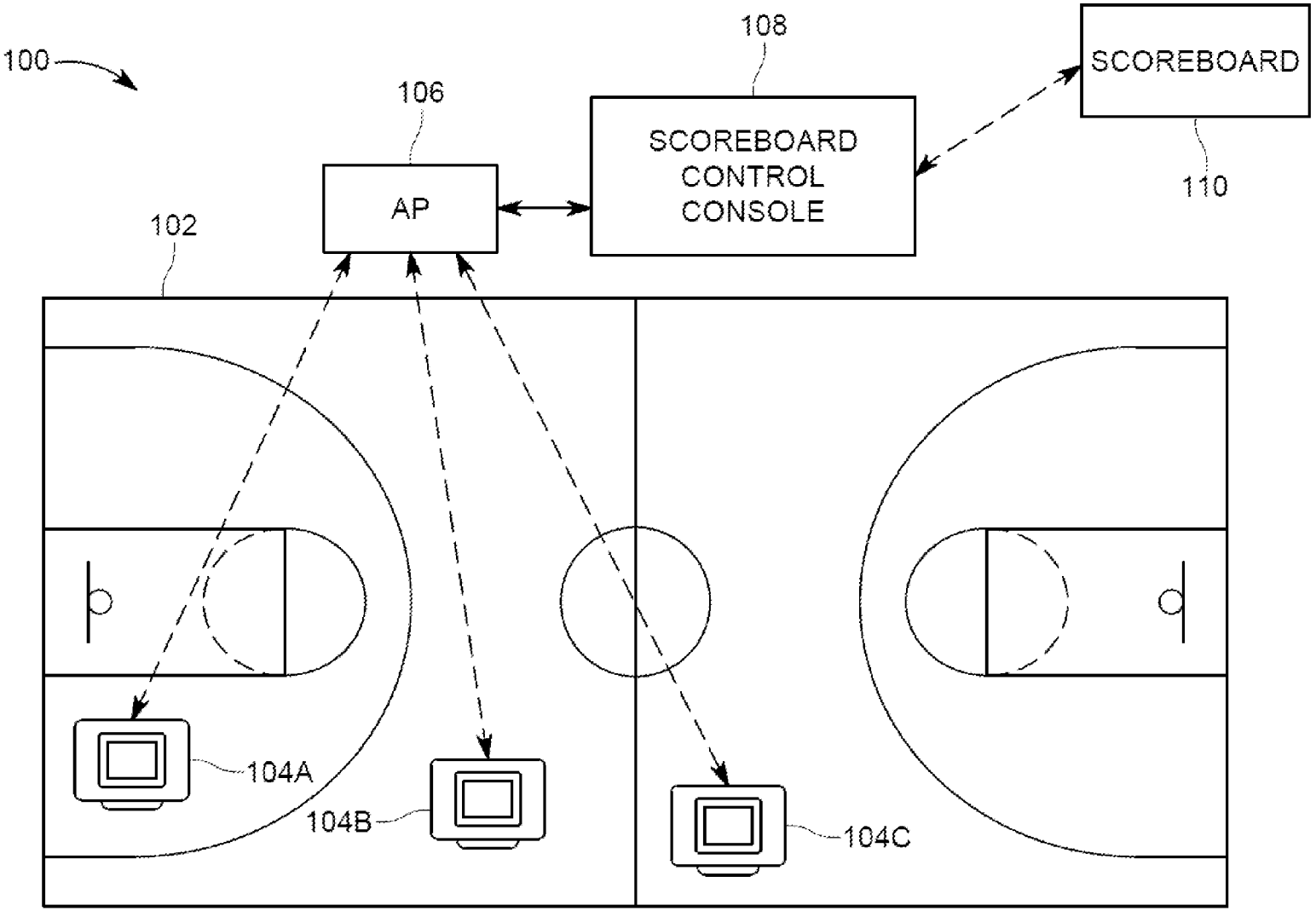
FIG. 1 depicts a diagram illustrating a system for facilitating a plurality of referees during a sporting event (e.g. a basketball game) in accordance with embodiments of the present disclosure.

The following description and drawings are illustrative and are not to be construed as limiting. Numerous specific details are described to provide a thorough understanding of the disclosure. However, in certain instances, well-known or conventional details are not described in order to avoid obscuring the description.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

FIG. 1 depicts a diagram illustrating a system 100 for facilitating a plurality of referees during a sporting event (e.g. a basketball game) in accordance with embodiments of the present disclosure. A basketball court 102 is depicted with mobile devices 104A-104C (e.g. belt packs) that may be carried on the waist bands or belts of three referees (not shown is FIG. 1). The mobile devices 104A-104C communicate over radio frequency (RF) wireless links with an access point 106. The access point 106 is electrically coupled with a scoreboard control console 108. A scoreboard 110 is either electrically coupled or wirelessly coupled with the scoreboard control console 108. The scoreboard control console 108 may be an OES control console, a Daktronics control console, or the like.

The access point 106 utilizes a DIN connector with unique cables to interface with specific wiring and connector interfaces for different manufacturers' control consoles (e.g. an XLR for the OES control consoles and an RJ11 for the Daktronics control consoles). The input and output communications between the access point 106 and scoreboard control console 108 include isolated switched state (dry contact) signals. The access point 106 has an input port requiring remote dry contact control that can be programmatically defined to accommodate features supported by various scoreboard consoles (e.g. the scoreboard control console 108 may output a state change when the clock reaches zero). The access point 106 supports the ability to program and map input and output connections for specific functions and wiring configurations.

The mobile devices 104A-104C can each detect a whistle blow and/or button events initiated by the referees, and immediately send a message to the access point 106. The access point 106 receives the message, decodes the message, and activates the remote input of the scoreboard control console 108 to either start or stop the clock. The access point 106 also sends the mobile devices 104A-104C an acknowledgement that the message was successfully received. The mobile devices 104A-104C use the acknowledgement to drive a haptic vibration motor alerting the referee that the start or stop event was successful. The entire transaction typically takes place in less than 50 milliseconds (mS). This response time is typically faster and more consistent than a human's reaction at the scoreboard control console 108.

The RF wireless links operate over a 902 mega-Hertz (MHz) to 928 MHz frequency band, which is outside the more used Bluetooth® and Wi-Fi frequency bands. The 902 MHz to 928 MHz frequency band provides excellent range and propagation characteristics as compared to the Bluetooth® and Wi-Fi frequency bands. The RF wireless links specifically use Wide-band Direct Sequence Spread Spectrum (WBDSSS) technology to minimize interference on a given link channel. Data for each RF wireless link of the mobile devices 104A-104C is spread across five channels each having a 200 kilo-Hertz (kHz) spacing (i.e. providing a 1 MHz wide effective channel). There are a total of 123 available channels with center frequencies of each 1 MHz effective channel on channels 3, 8, 13, . . . 123 (i.e. 902.8 MHz, 903.8 MHz, 904.8 MHz, . . . 926.8 MHz). The RF wireless links are each wide-band half-duplex spread spectrum. In some embodiments, frequency hopping may be employed for the RF wireless links.

The access point 106 may also sample a local RF spectrum at the basketball court 102 for interference and dynamically select the best channels for device commissioning and operation of the mobile devices 104A-104C. In some embodiments, RF mitigation steps such as separating the proximity of the mobile devices 104A-104C and the access point 106 may be required.

The mobile devices 104A-104C and the access point 106 may each transmit up to a power level of +10 decibel-milliwatts (dBm) with a receiver sensitivity of −110 dBm yielding a received signal strength indicator (RSSI) dynamic range of 95 dB. This provides much overhead for blockage of any of the RF wireless signals due to the bodies of players and/or referees. The mobile devices 104A-104C each include a helical printed circuit board (PCB) antenna. The access point 106 includes an external one half wave dipole antenna. Additionally, WBDSSS modulation enables Forward Error Correction (FEC) using K=4 as the constraint length in a convolutional encoder.

To minimize power consumption and prolong battery life, the mobile devices 104A-104C operate in a non-beacon mode and each generate a status/keep-alive message at a programmable interval. The status/keep-alive messages contain statistics associated with the mobile devices 104A-104C including their battery status. During network establishment, each of the mobile devices 104A-104C scan for incoming messages from the access point 106 at approximately 500 mS intervals to service key regeneration commands, over the air download commands, and remote configuration or control commands. This scan interval is also configurable.

Each of the mobile devices 104A-104C has a unique identifier (ID) in the form of a six-byte media access control (MAC) address and a configurable four-byte serial number. Up to fifty mobile devices may be supported by the access point 106. However, the access point 106 is typically configured to handle only four mobile devices per network session (i.e. game) as a default.

The network is compliant to the Institute of Electrical and Electronics Engineers (IEEE) 802.15.4 standard defining the MAC layer protocol.

Advanced Encryption Standard (AES) 128 encryption/decryption is used for the data at the MAC layer. The mobile devices 104A-104C and the access point 106 use secure commissioning with shared secret network keys for initial pairing (AES-CMAC). Unique dynamic device keys are generated using Elliptic Curve Diffie Hellman (ECDH) p256 during commissioning for run-time data exchange. The access point 106 communicates only with mobile devices with the shared secret key, and only accepts data that is encrypted with the dynamic device keys. The access point 106 controls both the generation and the storage of the dynamic device keys. Additional security is provided by limiting the number of associated mobile devices active during the network session (e.g. four devices—mobile devices 104A—104C and one spare mobile device). This number is also configurable.

All communications between the mobile devices 104A-104C and the access point 106 are acknowledged by a return message/packet. The system 100 is further configured to detect a whistle blow and/or button depress, and alert the scoreboard control console 108 in less than 50 mS. The mobile devices 104A-104C are also configured to alert each other via the access point 106 and initiating via haptic feedback in less than 250 mS.

The access point 106 logs and stores data of the mobile devices 104A-104C including timestamps, device IDs, events, and event data. For example, the event data may include when a scoreboard reaches 0:00:00 and/or game clock, period, time-outs, etc. Real time and stored data are available for Internet export. The access point 106 may be connected to the Internet via a Wi-Fi and/or Ethernet connection. Data may also be stored in the cloud in addition to a removable Secure Digital (SD) card.

Configuration data of the mobile devices 104A-104C is available via a remote application program interface (API) while connected with the access point 106. Additionally, software within the mobile devices 104A-104C may be updated by the remote API.

Figure 2:
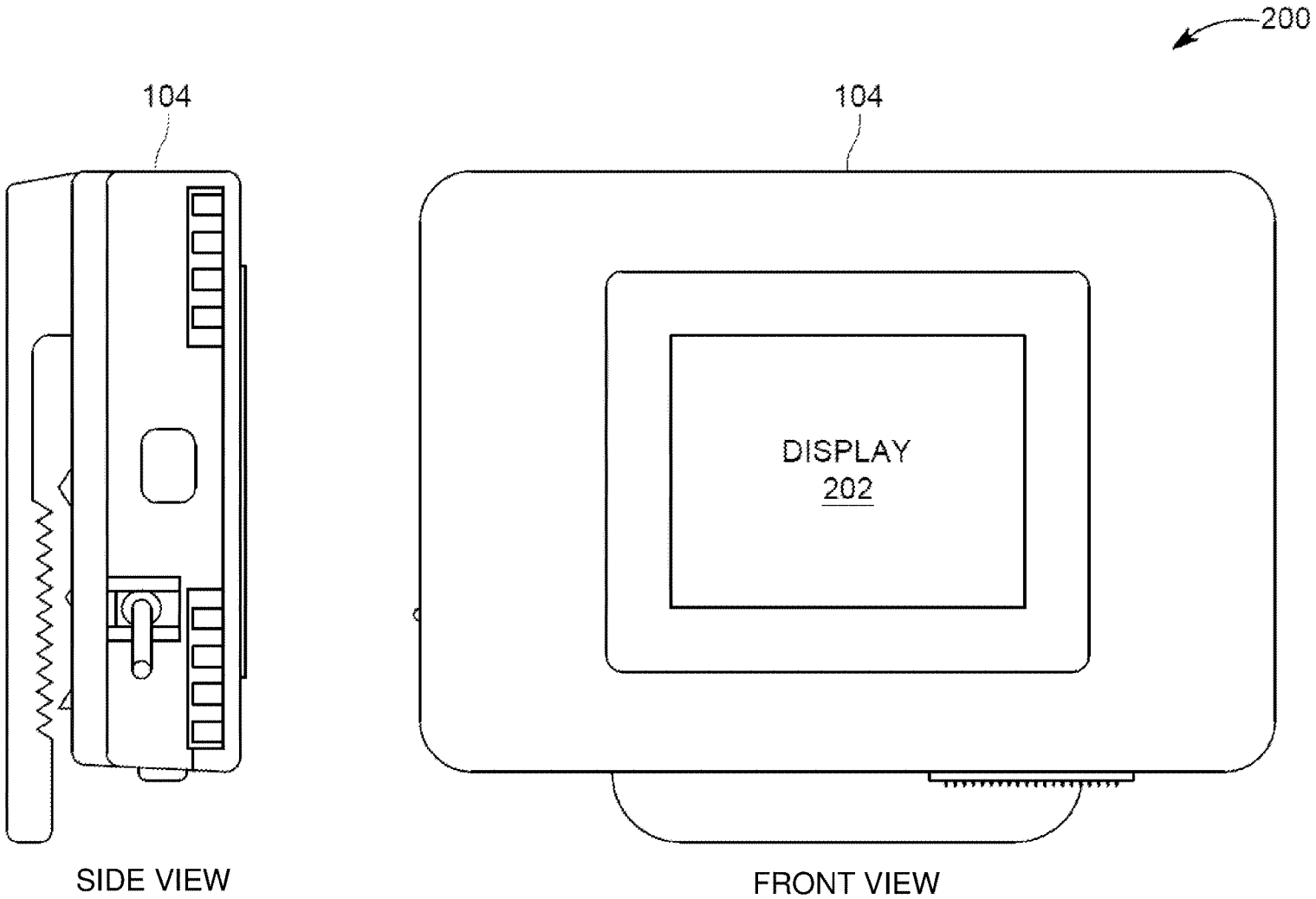
FIG. 2 depicts a diagram illustrating a side view and a front view of a mobile device of FIG. 1 in accordance with embodiments of the present disclosure.

FIG. 2 depicts a diagram 200 illustrating a side view and a front view of a mobile device 104 of FIG. 1 in accordance with embodiments of the present disclosure. The mobile device 104 includes rechargeable lithium batteries and a universal serial bus (USB) charging port. In some embodiments, the mobile device 104 may include a wireless charging port. The mobile device 104 is light weight and is configured to enter a sleep mode after approximately fifteen minutes of inactivity. The mobile device 104 is configured to save configuration data using onboard flash memory. C configuration data includes an access point ID, a network ID, frequency bands, frequency channels, serial number, and encryption/decryption keys.

The mobile device 104 also includes a display 202. Specifically, the display 202 is a color thin-film transistor (TFT) display with light emitting diode (LED) backlight supporting custom graphics. Tilt based operation further conserves battery light by dimming the display 202 when not being viewed by a referee.

Figure 3:
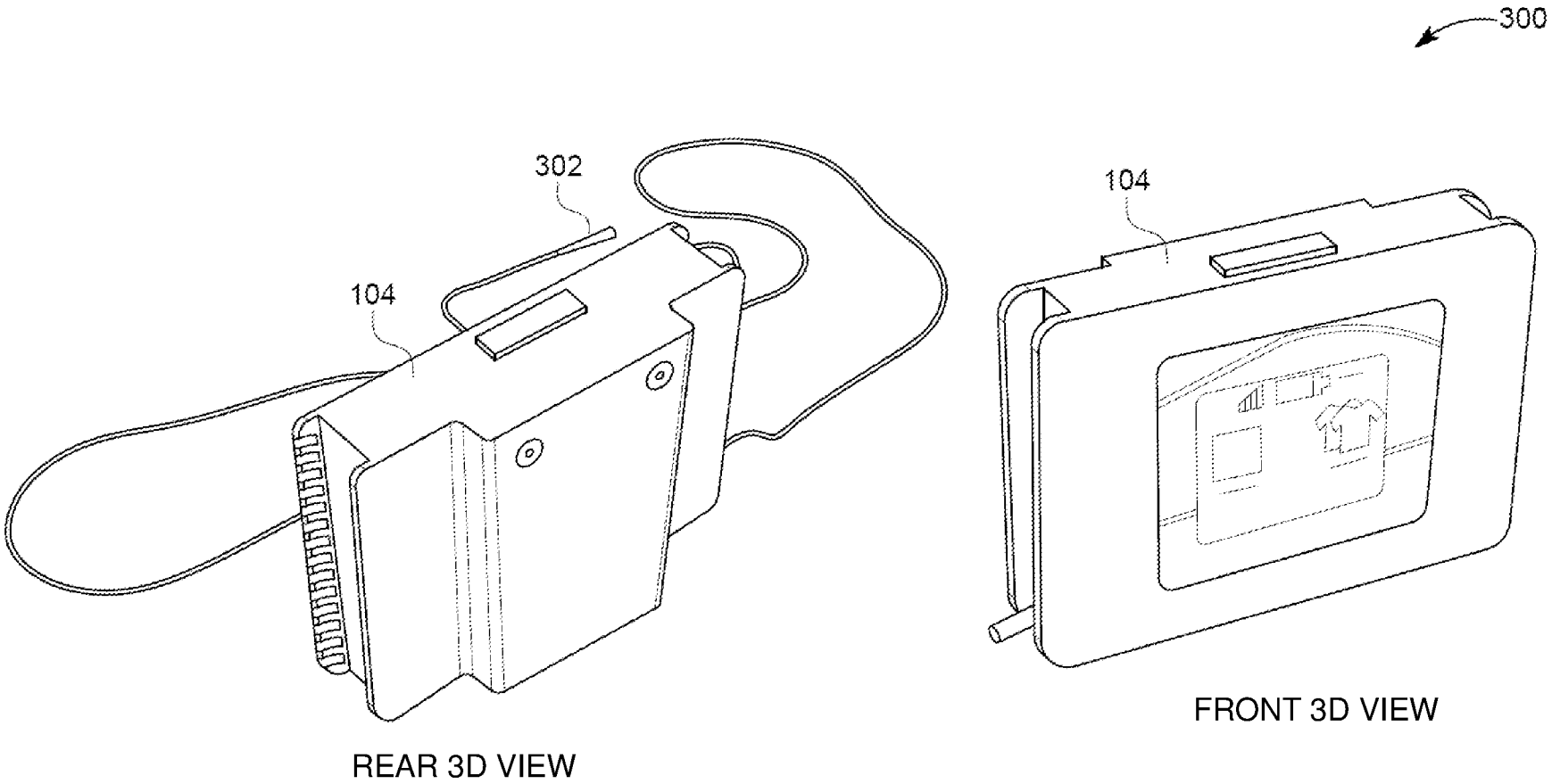
FIG. 3 depicts a diagram illustrating a rear three-dimensional view and front three-dimensional view of the mobile device of FIG. 2 in accordance with embodiments of the present disclosure.

FIG. 3 depicts a diagram 300 illustrating a rear three-dimensional view and front three-dimensional view of the mobile device 104 of FIG. 2 in accordance with embodiments of the present disclosure. The diagram 300 also depicts a microphone 302 of the mobile device 104 for detecting the whistle blows.

The microphone 302 easily adapts to standard lanyards and is tuned to the internal detection circuits of the mobile device 104. Larger cabling and flexible insulation resists wire breakage while electrically coupling the microphone 302 to the mobile device 104. In some embodiments, a wireless microphone (not shown in FIG. 3) may be used.

The mobile device 104 is further configured to detect a whistle blow based on amplitude, frequency, and duration of a received audio signal via the microphone 302. The mobile device 104 discriminates against false triggers by near-by whistles, heavy breathing, and crowd/fan noise. A power level threshold for the microphone 302 is adjustable through field calibration. The mobile device 104 may be adaptive and automatically make adjustments based upon background noise, whistle frequency, and/or whistle intensity. The frequency range is typically set to a center frequency of 3700 Hz and a bandwidth 1000 Hz. Signal power to noise ratio (SNR) in the frequency domain at the frequencies of interest are determined using primary filters deployed to resolve a whistle from other noise sources The mobile device 104 includes start and stop buttons with an ergonomic design providing intuitive button access while protecting against false button presses. The start and stop buttons are located on opposite planes of the mobile device 104 to eliminate incorrect presses by the user. Holding the stop button for approximately five seconds powers down the mobile device 104. Holding down the start button will power up the mobile device 104.

The mobile device 104 also includes haptic feedback technology for responding to acknowledgement packets/messages received from the access point 106. Patterns and intensity of haptic feedback are under software.

Figure 4:
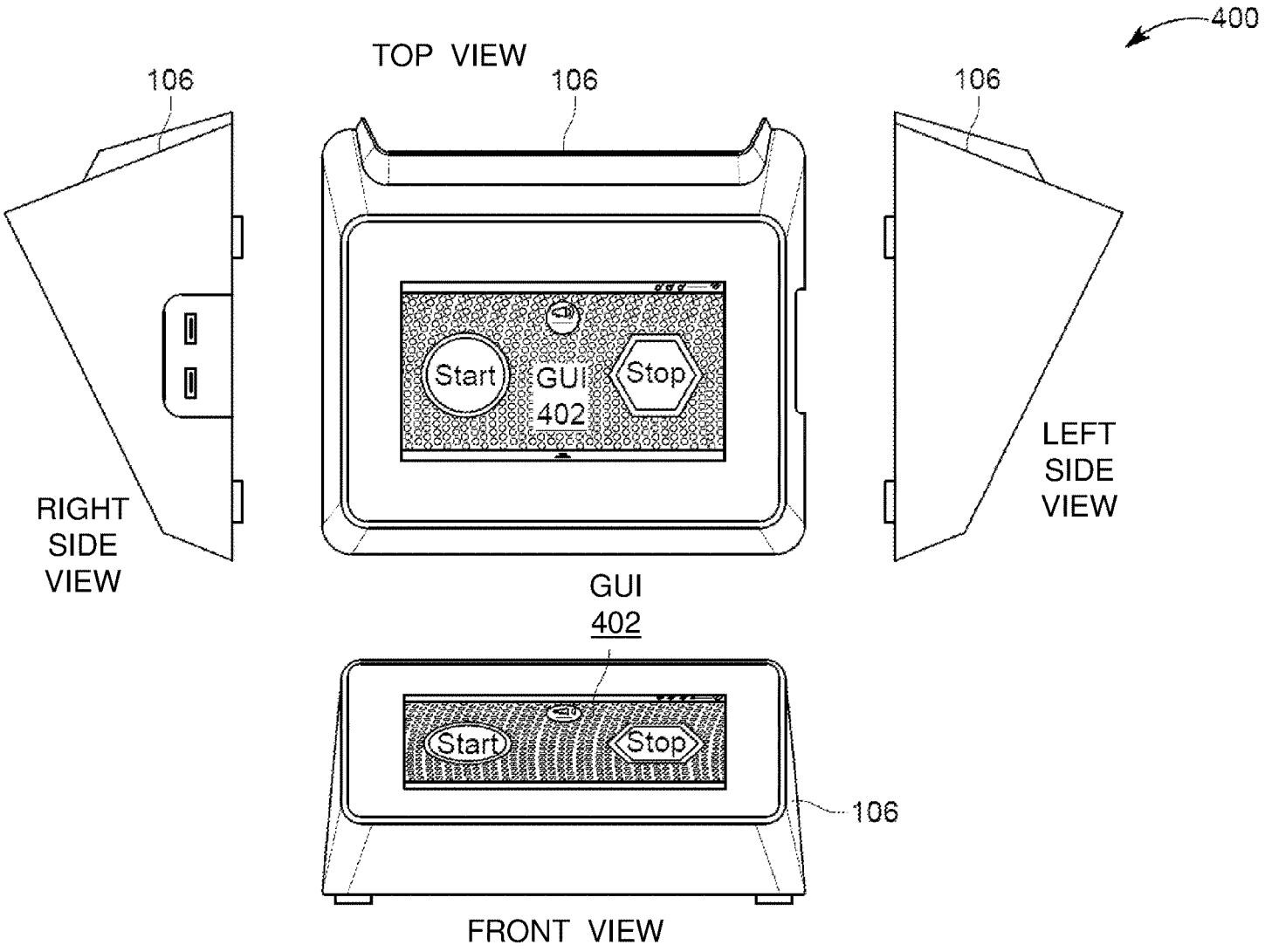
FIG. 4 depicts a diagram illustrating a front view, a top view, a right side view and a left side view of the access point of FIG. 1 and a graphical user interface (GUI) in accordance with embodiments of the present disclosure.

FIG. 4 depicts a diagram 400 illustrating a front view, a top view, a right side view and a left side view of the access point 106 of FIG. 1 in accordance with embodiments of the present disclosure. The diagram 400 also illustrates a graphical user interface (GUI) 402 illustrating game time functions of the access point 106.

Figure 5:
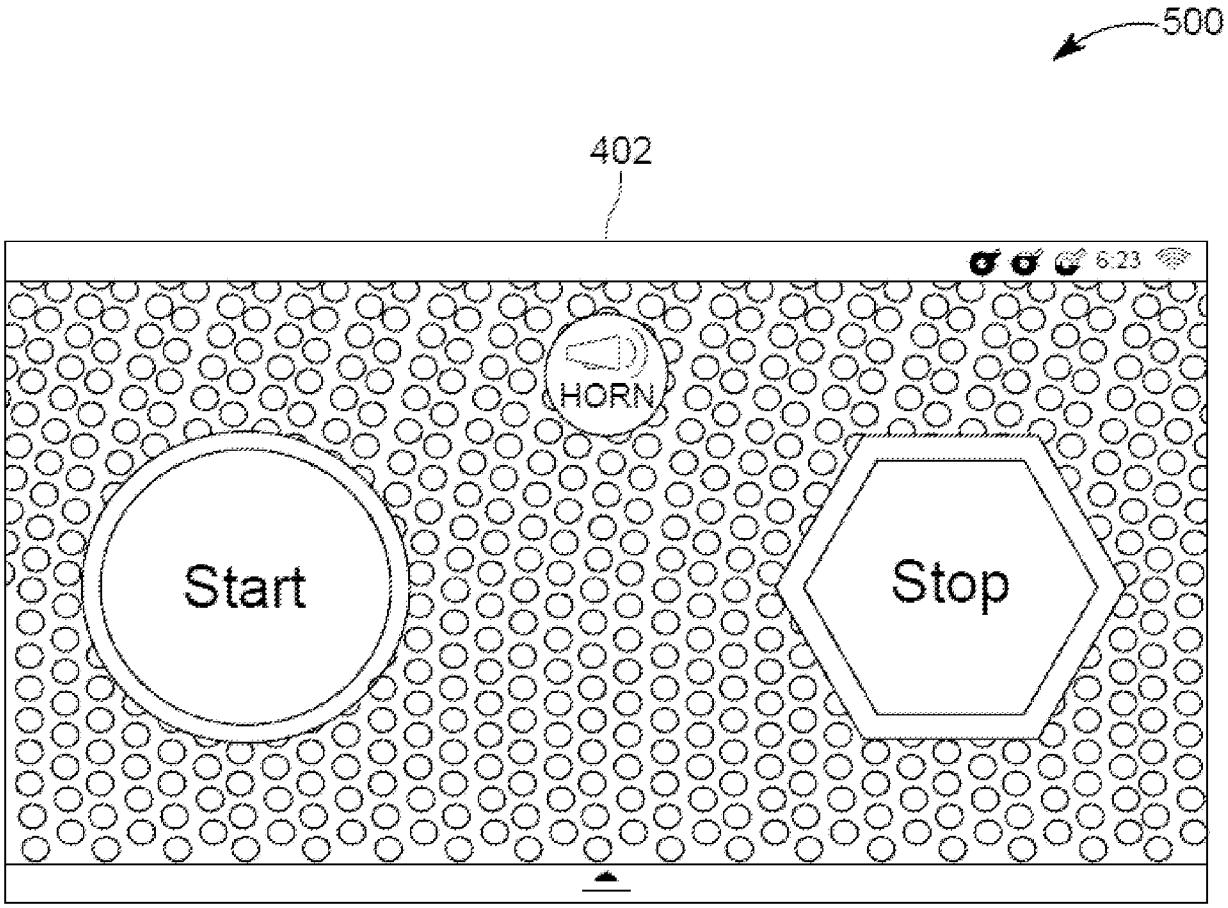
FIG. 5 depicts a diagram illustrating the GUI of the access point of FIG. 4 displaying primary functions (e.g. set up) in accordance with embodiments of the present disclosure.

FIG. 5 depicts a diagram 500 illustrating the GUI 402 of the access point 106 of FIG. 4 displaying primary functions in accordance with embodiments of the present disclosure. The primary functions include a start button, a stop button, and a horn button. Connectivity status and remaining battery power of mobile device 104A through 104C is also displayed. Additionally, time remaining on the game clock is displayed. In some embodiments, time remaining on the shot clock may be displayed. In still other embodiments, the current time may be displayed.

Figure 6:
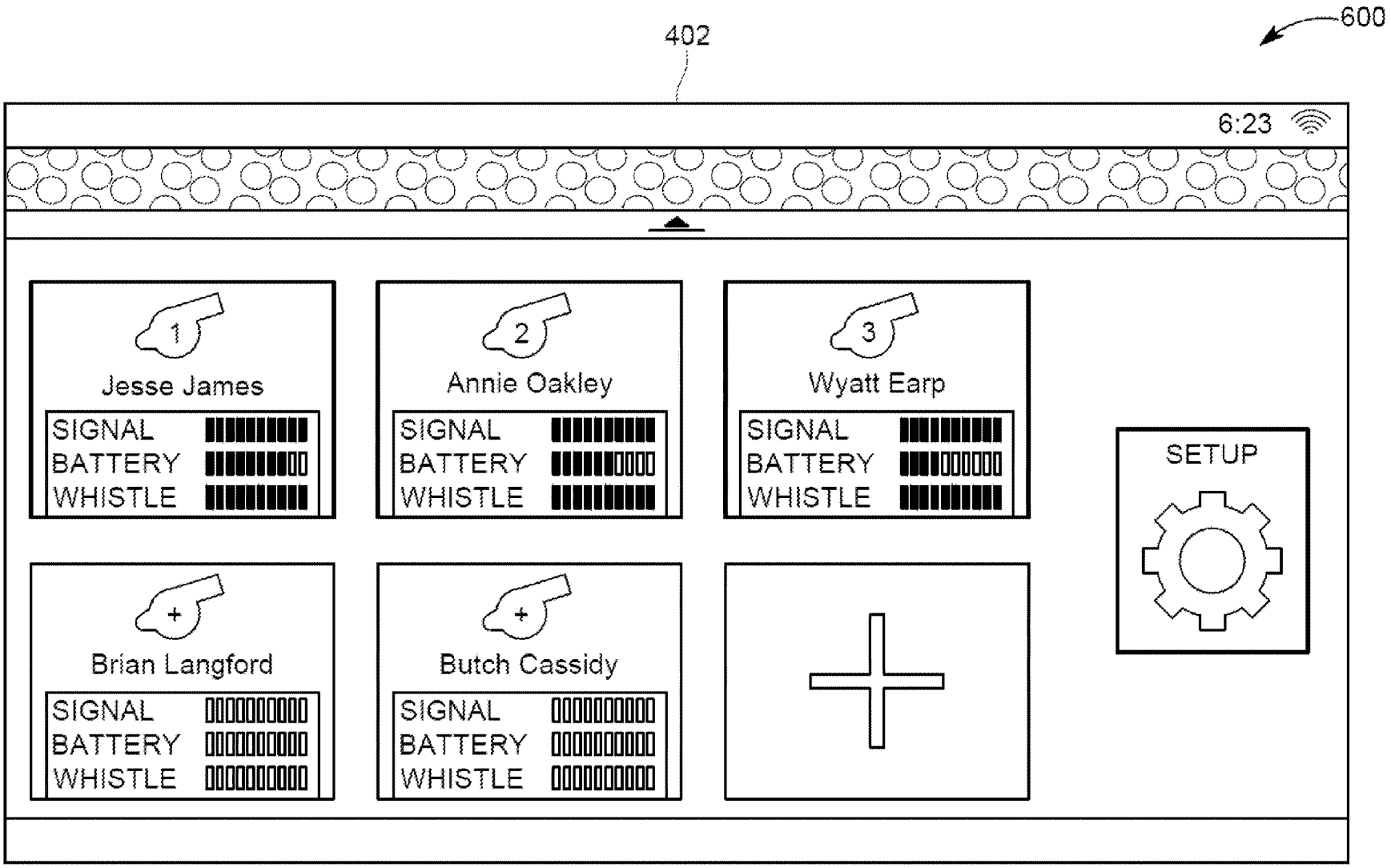
FIG. 6 depicts a diagram illustrating the GUI of the access point of FIG. 1 displaying a diagnostics and pairing screen in accordance with embodiments of the present disclosure in accordance with embodiments of the present disclosure.

FIG. 6 depicts a diagram 600 illustrating the GUI 402 of the access point 106 of FIG. 1 displaying a diagnostics and pairing screen in accordance with embodiments of the present disclosure. RF power level, battery status, and whistle detect levels are also displayed for the mobile devices 104A-104C.

Figure 7:
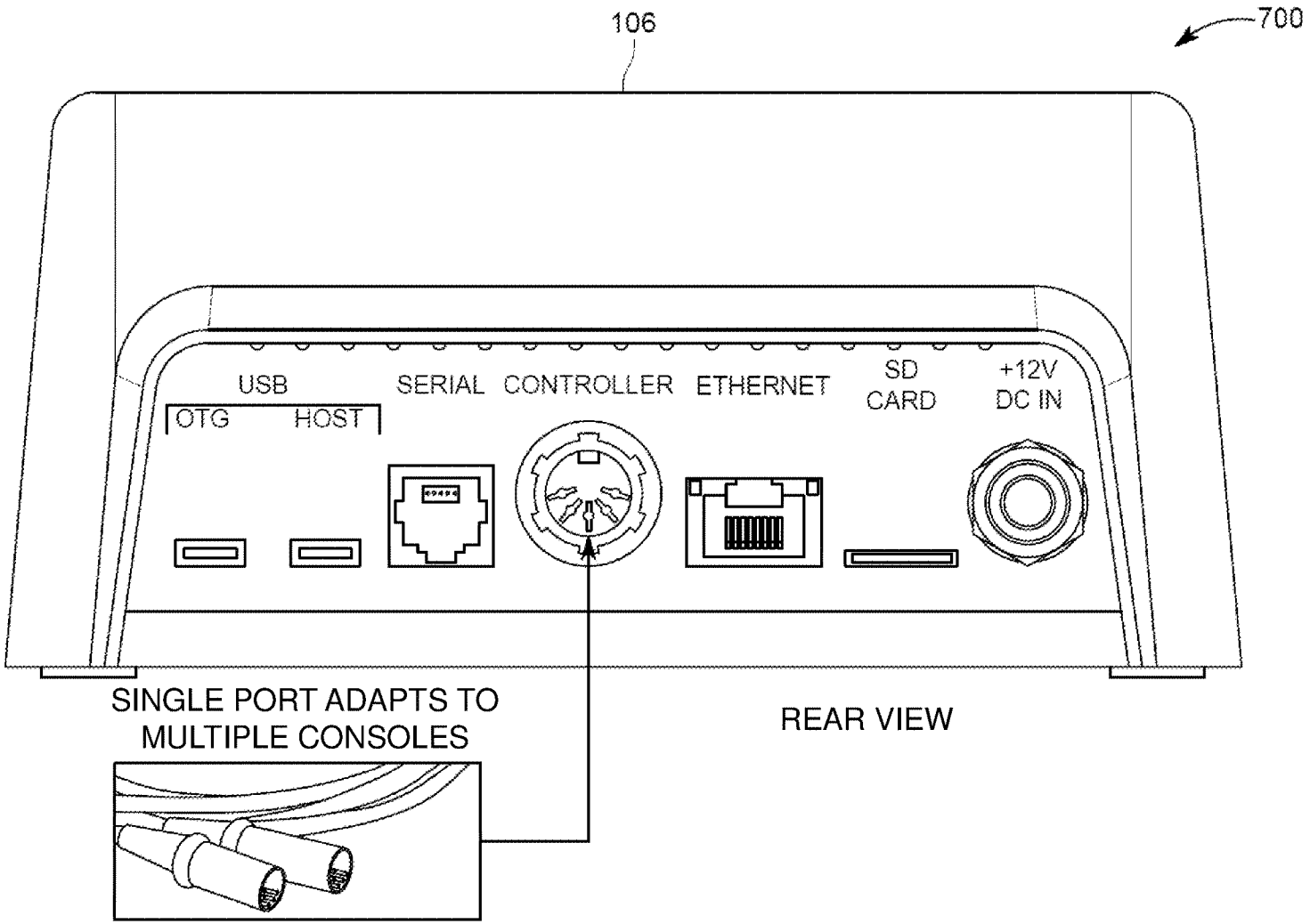
FIG. 7 depicts a diagram 700 illustrating a rear view of the access point 106 of FIG. 1 in accordance with embodiments of the present disclosure in accordance with embodiments of the present disclosure.

FIG. 7 depicts a diagram 700 illustrating a rear view of the access point 106 of FIG. 1 in accordance with embodiments of the present disclosure.

Figure 8:
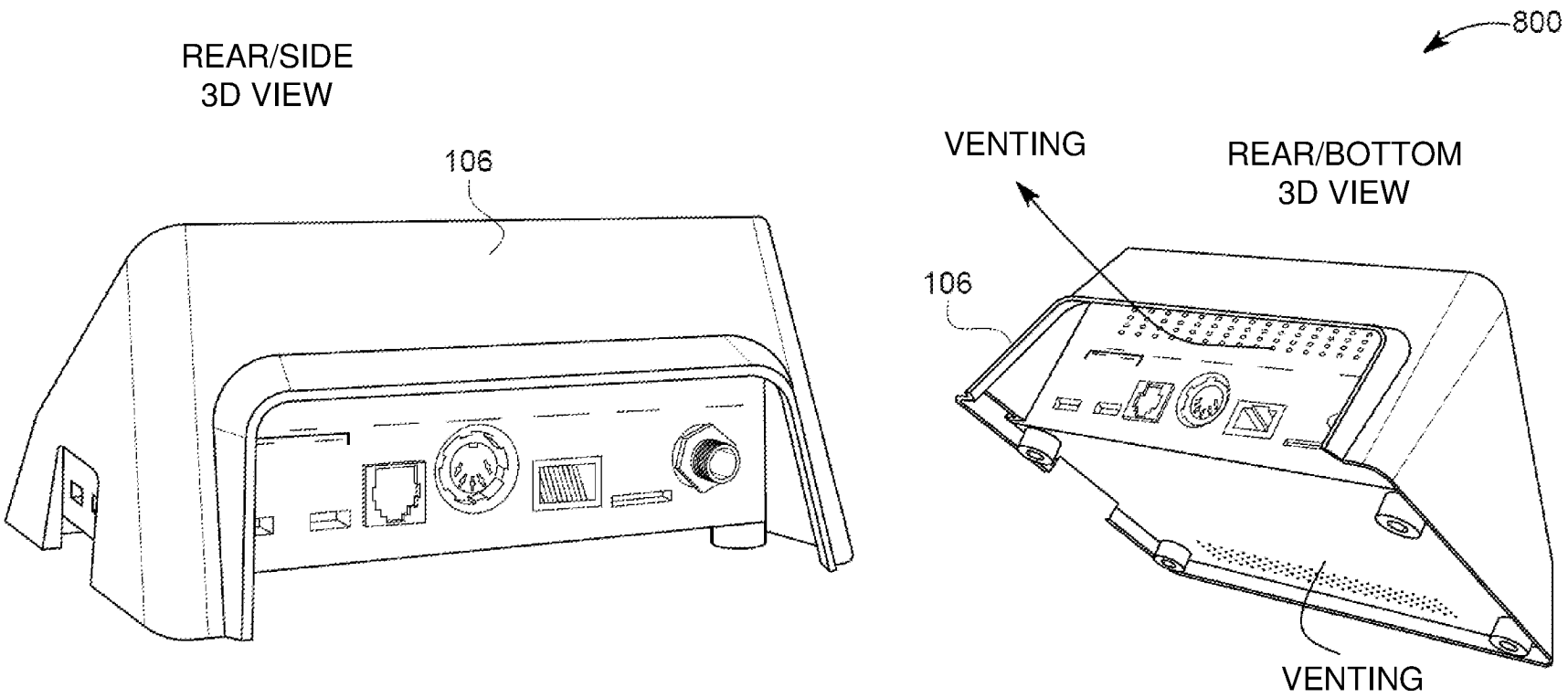
FIG. 8 depicts a diagram illustrating a rear/side three-dimensional view and a rear/bottom three-dimensional view of the access point of FIG. 1 in accordance with embodiments of the present disclosure.

FIG. 8 depicts a diagram 800 illustrating a rear/side three-dimensional view and a rear/bottom three-dimensional view of the access point 106 of FIG. 1 in accordance with embodiments of the present disclosure.

Figure 9:
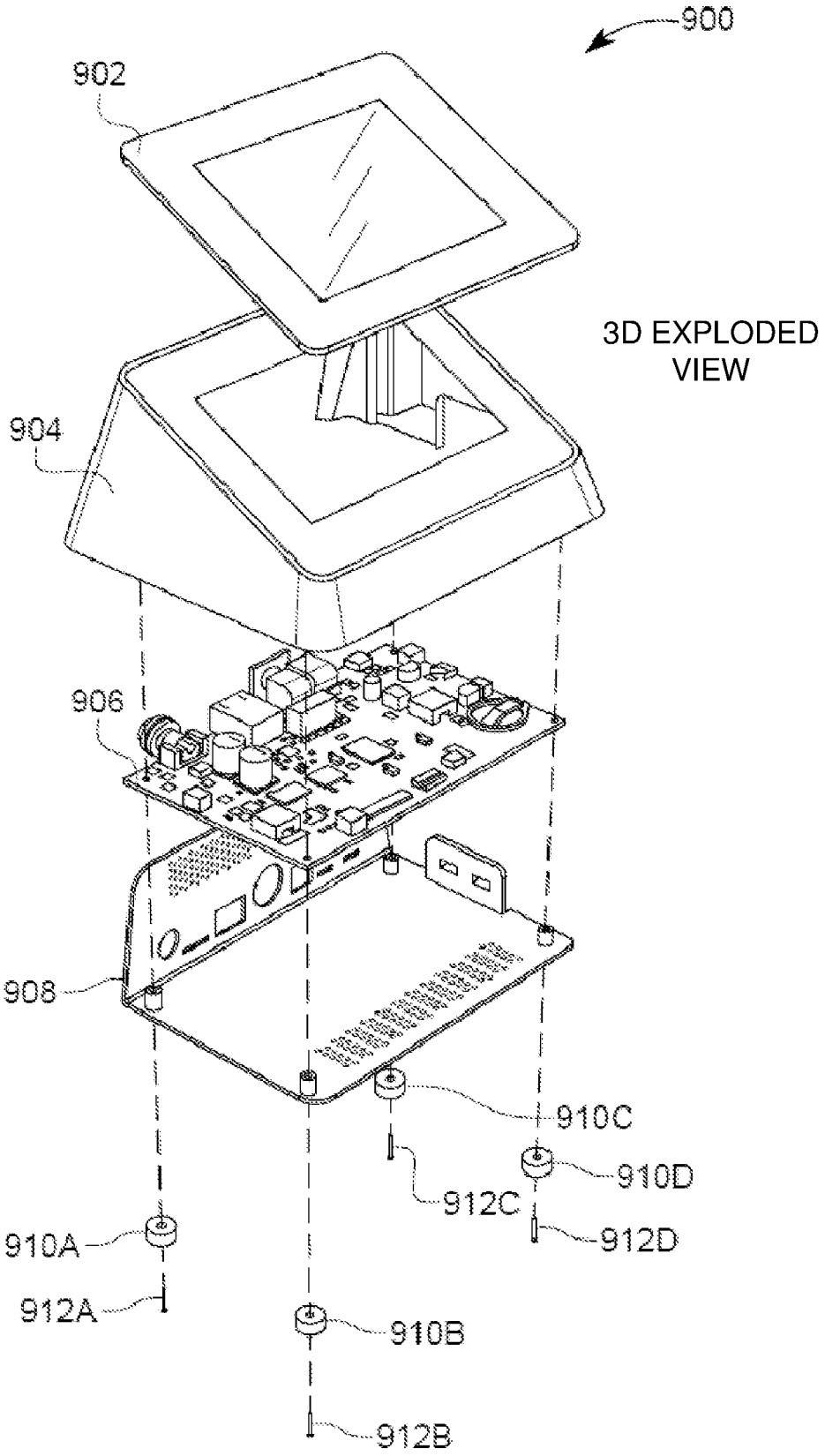
FIG. 9 depicts a diagram illustrating a three-dimensional exploded view of the access point of FIG. 1 in accordance with embodiments of the present disclosure.

FIG. 9 depicts a diagram 900 illustrating a three-dimensional exploded view of the access point 106 of FIG. 1 in accordance with embodiments of the present disclosure. The diagram 900 includes a touch display assembly 902, a main enclosure 904, a PCB assembly 906, a metal base assembly 908, rubber feet 910A-910D, and fasteners 912A-912D.

Figure 10:
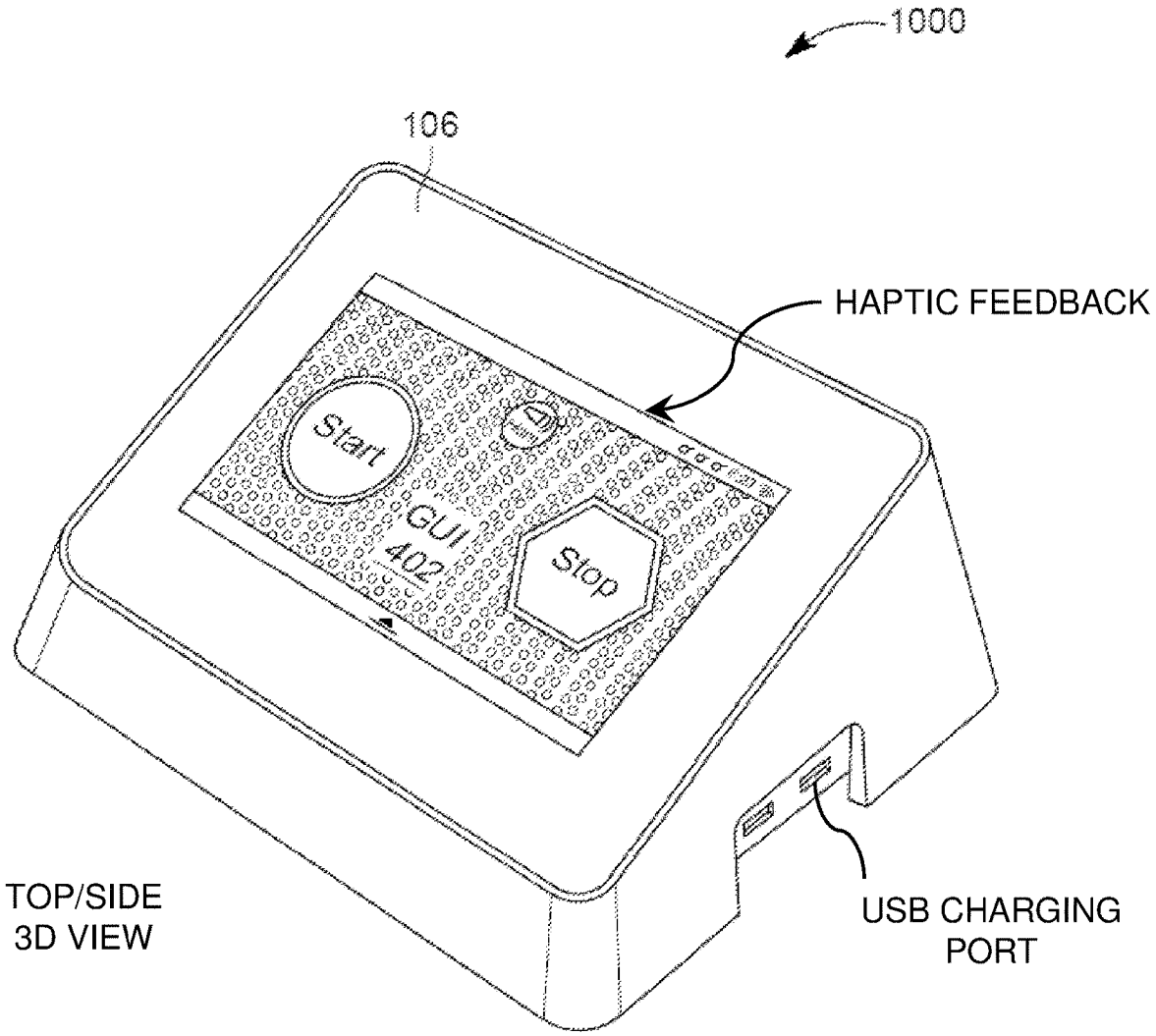
FIG. 10 depicts a diagram illustrating a top/side three-dimensional view of the access point of FIG. 1 including universal serial bus (USB) charging ports in accordance with embodiments of the present disclosure.

FIG. 10 depicts a diagram 1000 illustrating a top/side three-dimensional view of the access point 106 of FIG. 1 including universal serial bus (USB) charging ports and haptic feedback indicator in accordance with embodiments of the present disclosure.

Figure 11:
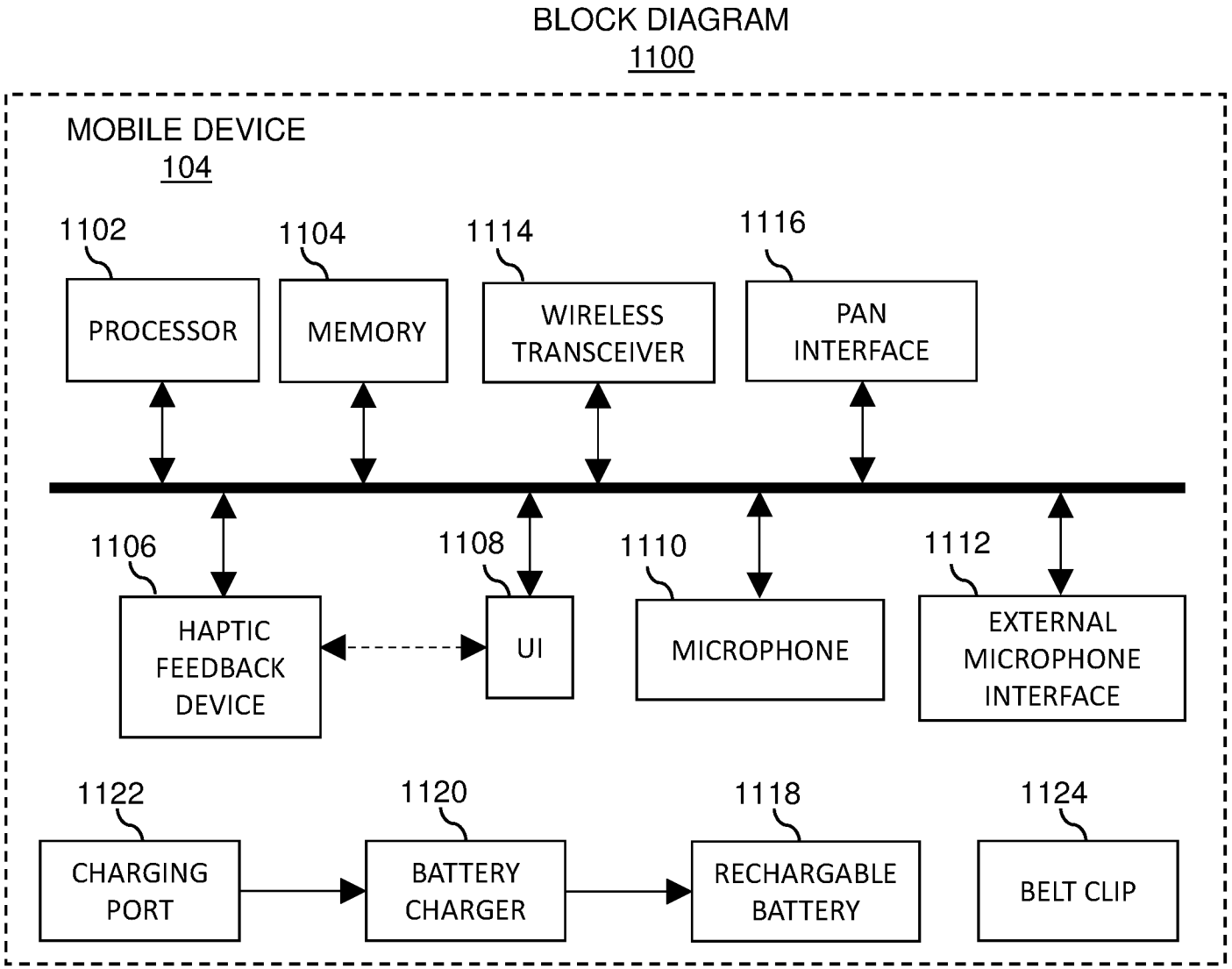
FIG. 11 depicts a block diagram of the mobile device of FIG. 2 in accordance with embodiments of the present disclosure.

FIG. 11 depicts a block diagram 1100 of the mobile device 104 of FIG. 2 in accordance with embodiments of the present disclosure. The mobile device 104 includes a processor 1102, a memory 1104, a haptic feedback device 1106 and a user interface (UI) 1108. In some embodiments, the memory 1104 or a portion of the memory 1104 may be integrated with the processor 1102. The memory 1104 may include a combination of volatile memory and non-volatile memory. In some embodiments the processor 1102 and the memory 1104 may embedded in a microcontroller. The UI 1108 may be a touchpad display. The haptic feedback device 1106 may be mechanically coupled with a case of the mobile device 104 and/or the UI 1108.

The mobile device 104 also includes a microphone 1110 and an external microphone interface 1112. The external microphone interface 1112 may be configured to be coupled with a lavalier microphone.

The mobile device 104 further includes a wireless transceiver 1114 and a PAN interface 1116. The wireless transceiver 1114 may be configured to transmit and receive WBDSSS compliant signals. The WBDSSS signals may be associated with a 902 MHz to 928 MHz frequency band.

The PAN interface 1116 may be may be compliant to at least one version of a Bluetooth® standard. The PAN interface 1116 may also be configured to wirelessly couple to an external microphone (e.g., Bluetooth microphone).

The mobile device 104 derives power from a rechargeable battery 1118. A battery charger 1120 is configured to receive external power from a charging port 1120. The charging port 1120 may be configured to be coupled to a USB charger. The wireless charging port 1120 may also be a wireless charging port. A belt clip 1124 is included for attaching the mobile device 104 to a game official (e.g., referee).

The processor 1102 (via program steps stored in the memory 1104) may be configured for (1) receiving an audio signal via the microphone 1110 or the microphone interface 1112; (2) determining the audio signal is associated with a whistle blow; (3) upon determining the audio signal is associated with the whistle blow, transmitting a device message via the wireless transceiver 1114 to the access point 106; (4) receiving an access point acknowledgment message from the access point 106 via the wireless interface 1114; and (5) upon receiving the access point acknowledgement message, activating the haptic feedback device 1106 for a period of time.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including object oriented and/or procedural programming languages. Programming languages may include, but are not limited to: Ruby, JavaScript, Java, Python, Ruby, PHP, C, C++, C #, Objective-C, Go, Scala, Swift, Kotlin, OCaml, or the like. The program code may execute entirely on the user's computer, partly on the user's computer, as a standalone software package, partly on the user's computer, and partly on a remote computer or entirely on the remote computer or server.

Aspects of the present invention are described in the instant specification with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a user" can include a plurality of such users, and so forth. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A mobile device for facilitating an official of a sporting event, the mobile device comprising:

a processor;

a memory electrically coupled with the processor;

a microphone interface electrically coupled with the processor;

a user interface electrically coupled with the processor;

a haptic feedback device electrically coupled with the processor; and a wireless transceiver electrically coupled with the processor, wherein the processor is configured for:

receiving a first audio signal via the microphone interface;

determining the first audio signal is associated with a first whistle blow; and upon determining the first audio signal is associated with the first whistle blow, transmitting a first device message via the wireless transceiver to an access point;

receiving a first access point acknowledgment message from the access point; and upon receiving the first access point acknowledgement message, activating the haptic feedback device for a first period of time;

receiving a first device command from the user interface;

upon receiving the first device command, transmitting a second device message to the access point and activating the haptic feedback device for a second period of time, wherein:

the access point is electrically coupled with a scoreboard controller;

the access point is configured for:

transmitting a first access point message to the scoreboard controller upon receiving the first device message; and transmitting a second access point message to the scoreboard controller upon receiving the second device message;

the first access point message is configured to stop a game clock associated with the scoreboard controller; and the second access point message is configured to start the game clock associated with the scoreboard controller.

2. The mobile device of claim 1, wherein the processor is further configured for:

receiving a third access point message via the wireless transceiver, wherein the third access point message is associated with a second whistle blow detected by another mobile device; and upon receiving the third access point message, activating the haptic feedback device for a third period of time.

3. The mobile device of claim 2, wherein the processor is further configured for:

receiving a fourth access point message via the wireless transceiver, wherein the fourth access point message is associated with a start of the game clock; and upon receiving the fourth access point message, activating the haptic feedback device for a fourth period of time.

4. The mobile device of claim 1, wherein the user interface comprises a push button.

5. The mobile device of claim 1 further comprising a belt clip.

6. The mobile device of claim 1, wherein the microphone interface is configured to be electrically coupled with a lavalier microphone.

7. The mobile device of claim 1, wherein the microphone interface is configured to be wirelessly coupled with a microphone.

8. The mobile device of claim 7, wherein the microphone interface is a wireless personal area network (PAN) interface.

9. The mobile device of claim 8, wherein the microphone interface is compliant to at least one version of a Bluetooth® standard.

10. The mobile device of claim 1 further comprising a rechargeable battery.

11. The mobile device of claim 10 further the rechargeable battery is a lithium-ion rechargeable battery.

12. The mobile device of claim 10 further comprising a charging port electrically coupled with the rechargeable battery.

13. The mobile device of claim 12, wherein the charging port is compliant to a universal serial bus (USB) charger.

14. The mobile device of claim 12, wherein the charging port is a wireless charging port.

15. The mobile device of claim 1 further comprising a display electrically coupled with the processor.

16. The mobile device of claim 15 wherein the display is configured to provide a game status of the sporting event.

17. The mobile device of claim 1, wherein determining the first audio signal is associated with the first whistle blow comprises determining a spectral component within the first audio signal above predetermined sound pressure threshold and having a frequency component between 2700 Hertz and 4700 Hertz.

18. A method for facilitating an official of a sporting event, the method comprising:

receiving a first audio signal via a microphone interface of a mobile device, the mobile device comprising:

a processor electrically with the microphone interface;

a memory electrically coupled with the processor;

a user interface electrically coupled with the processor;

a haptic feedback device electrically coupled with the processor; and a wireless transceiver electrically coupled with the processor;

determining the first audio signal is associated with a first whistle blow;

upon determining the first audio signal is associated with the first whistle blow, transmitting a first device message via the wireless transceiver to an access point;

receiving a first access point acknowledgment message from the access point; and upon receiving the first access point acknowledgement message, activating the haptic feedback device for a first period of time;

receiving a first device command from the user interface;

upon receiving the first device command, transmitting a second device message to the access point and activating the haptic feedback device for a second period of time, wherein:

the access point is electrically coupled with a scoreboard controller;

the access point is configured for:

transmitting a first access point message to the scoreboard controller upon receiving the first device message; and transmitting a second access point message to the scoreboard controller upon receiving the second device message;

the first access point message is configured to stop a game clock associated with the scoreboard controller; and the second access point message is configured to start the game clock associated with the scoreboard controller.

19. The mobile device of claim 17, wherein the predetermined sound pressure threshold is between 104 decibels and 116 decibels.

20. The mobile device of claim 17, wherein the predetermined sound pressure threshold is configurable automatically based on background noise.

* * * * *